US012600910B2

(12) United States Patent
Pendray et al.

(10) Patent No.: US 12,600,910 B2
(45) Date of Patent: Apr. 14, 2026

(54) UPDRAFT GASIFIER AND METHOD, APPARATUS, AND SYSTEM FOR BIOMASS DECOMPOSITION

(71) Applicant: Cummins Inc., Columbus, IN (US)

(72) Inventors: John R. Pendray, Blaine, MN (US); Ismael Chang, Plymouth, MN (US); Jaimie E. Hamilton-Antonson, Minneapolis, MN (US)

(73) Assignee: Cummins Inc., Columbus, IN (US)

( * ) Notice: Subject to any disclaimer, the term of this patent is extended or adjusted under 35 U.S.C. 154(b) by 79 days.

(21) Appl. No.: 17/355,570

(22) Filed: Jun. 23, 2021

(65) Prior Publication Data

US 2021/0317374 A1 Oct. 14, 2021

Related U.S. Application Data

(63) Continuation of application No. PCT/US2020/015205, filed on Jan. 27, 2020.
(Continued)

(51) Int. Cl.
*C10B 7/02* (2006.01)
*C10B 7/00* (2006.01)
(Continued)

(52) U.S. Cl.
CPC ..... *C10B 7/02* (2013.01); *C10B 7/00* (2013.01); *C10B 7/10* (2013.01); *C10B 33/02* (2013.01);
(Continued)

(58) Field of Classification Search
CPC .... C10J 2200/09; C10J 2200/158; C10J 3/32; F23G 2900/50005; F23G 5/28; F23G 5/30
See application file for complete search history.

(56) References Cited

U.S. PATENT DOCUMENTS 3,671,167 A 6/1972 Nakano
3,834,326 A 9/1974 Sowards
(Continued)

FOREIGN PATENT DOCUMENTS

CA 1241541 9/1988
EP 0924288 A2 * 6/1999 ..... C10J 3/26
(Continued)

OTHER PUBLICATIONS

International Search Report and Written Opinion, PCT Appln. No. PCT/US20/15205, Apr. 8, 2020, 9 pgs.
(Continued)

*Primary Examiner* — Imran Akram
(74) *Attorney, Agent, or Firm* — Taft Stettinius & Hollister LLP

(57) ABSTRACT

A method, system, and apparatus for decomposing a biomass feedstock include providing a layer of inert particulate matter, such as sand, to line and insulate the bottom surface of a main chamber of a reactor where pyrolysis and oxidation are conducted to produce char and producer gases as primary products. In an embodiment, feedstock positioned in a side region of the reaction chamber insulates side walls of the main chamber from heat in the center region of the main chamber. In an embodiment of the method, a rate of removal of solid products such as char from the reactor is controlled in response to a temperature detected at a position of an extraction tube inlet of the reactor. Activated charcoal may be obtained as a primary product using the system and method, by feeding oxygen into the reactor at an inlet positioned adjacent to an inlet to the extraction chamber.

23 Claims, 2 Drawing Sheets

Related U.S. Application Data

(60) Provisional application No. 62/798,025, filed on Jan. 29, 2019.

(51) Int. Cl.

| | |
|---|---|
| ***C10B 7/10*** | (2006.01) |
| ***C10B 33/02*** | (2006.01) |
| ***C10J 3/16*** | (2006.01) |
| ***F23G 5/24*** | (2006.01) |
| ***F23G 5/28*** | (2006.01) |

(52) U.S. Cl.

CPC ..... *C10J 3/16* (2013.01); *F23G 5/24* (2013.01); *F23G 5/28* (2013.01); *C10J 2200/09* (2013.01); *C10J 2200/158* (2013.01)

(56) References Cited

U.S. PATENT DOCUMENTS

| | | | | |
|---|---|---|---|---|
| 3,971,639 | A * | 7/1976 | Matthews | C10J 3/463 252/373 |
| 4,508,039 | A | 4/1985 | Noguchi et al. | |
| 5,620,488 | A * | 4/1997 | Hirayama | C10J 3/503 48/209 |
| 5,980,858 | A * | 11/1999 | Fujimura | C10K 3/04 48/DIG. 2 |
| 6,048,374 | A * | 4/2000 | Green | C10J 3/10 110/235 |
| 6,133,499 | A * | 10/2000 | Horizoe | F22B 31/045 110/243 |
| 6,669,822 | B1 * | 12/2003 | Fujimura | C10J 3/482 201/37 |
| 6,830,597 | B1 * | 12/2004 | Green | C10B 53/02 110/235 |
| 8,562,701 | B2 | 10/2013 | Heidenreich et al. | |
| 9,175,439 | B2 | 11/2015 | Tegman | |
| 9,670,413 | B2 | 6/2017 | Baird et al. | |
| 2004/0107638 | A1 * | 6/2004 | Graham | C10J 3/30 422/165 |
| 2011/0083953 | A1 * | 4/2011 | Horn | C10B 53/07 201/25 |
| 2012/0012039 | A1 * | 1/2012 | Palmas | C10C 5/00 110/259 |
| 2014/0290593 | A1 | 10/2014 | Krammer | |
| 2015/0059245 | A1 * | 3/2015 | Appel | C10J 3/32 48/209 |
| 2015/0291896 | A1 * | 10/2015 | Zwart | C10J 3/485 48/86 R |
| 2016/0068757 | A1 * | 3/2016 | Cui | C10J 3/723 202/117 |
| 2017/0349847 | A1 * | 12/2017 | Thiessen | C10J 3/32 |
| 2020/0063052 | A1 * | 2/2020 | Thiessen | C10J 3/723 |

FOREIGN PATENT DOCUMENTS

| | | | |
|---|---|---|---|
| WO | WO-2008108644 A1 * | 9/2008 | B01J 8/1872 |
| WO | 2009093107 | 7/2009 | |
| WO | 2010095025 | 8/2010 | |
| WO | 2014138551 | 9/2014 | |
| WO | 2016178175 | 11/2016 | |
| WO | 2018213474 | 11/2018 | |
| WO | 2018225047 | 12/2018 | |

OTHER PUBLICATIONS

First Examination Report, Counter Indian Application No. 202147032937, Dated Nov. 3, 2022, 6 pgs.

Extended European Search Report, Counter EP Application No. 20748381.9, Dated Feb. 15, 2022, 9 pgs.

First Examination Report, Counter Indian Application No. 202348029687, Dated Jun. 6, 2023, 4 pgs.

Communication Pursuant to Article 94(3) EPC; European Patent Office; European Patent Application No., Counter EP Application No. 20748381.9, Dated May 22, 2024, 6 pgs.

Extended European Search Report, Counter EP Application No. 25184558.2, Dated Sep. 8, 2025, 6 pgs.

* cited by examiner

UPDRAFT GASIFIER AND METHOD, APPARATUS, AND SYSTEM FOR BIOMASS DECOMPOSITION

RELATED APPLICATION

This application is a continuation of International Patent Application No. PCT/US20/15205 filed on Jan. 27, 2020, which claims priority under 35 U.S.C. § 119(e) to and the benefit of the filing date of U.S. Provisional Patent Application No. 62/798,025 filed Jan. 29, 2019, each of which is incorporated herein by reference in its entirety for all purposes.

TECHNICAL FIELD

The present disclosure relates generally to apparatus and methods for decomposition of a biomass feedstock to produce gaseous fuels and char as products. In particular, the disclosure relates to improved methods, apparatus, and systems for biomass decomposition that improve cost efficiency by providing efficient and inexpensive insulation of the walls of the reactor, and efficient means for removal and cooling of a char product of the reactions.

BACKGROUND

The reactor bodies of biomass decomposition systems and gasifier systems such as updraft gasifiers generally must be made from expensive materials that are able to withstand the very high temperatures in the zones in which pyrolysis and oxidation are conducted, which may range from around 250° C. to over 1600° C. The pyrolysis and oxidation reactions may occur in zones of the reactor body that are positioned near surface walls of the reactor body, requiring high temperature refractory materials to be used to construct the bodies, or requiring complex constructions including insulating layers that protect the bodies, but in each case adding to the cost and/or complexity of design. In many biomass gasifiers, the biomass feedstock is completely consumed to generate producer gas, except for the non-reactive ash. The ash can form slag and cause reliability issues, and past solutions to this problem involved efforts to provide continuous and complete agitation of the biomass in the reactor in order to ensure regular dispersion of the biomass. Current methods and systems also lack cost-effective and efficient ways to capture and remove char as a product of the reactions. Improvements are needed to address these shortcomings and to improve cost efficiency of methods and systems for decomposition of biomass feedstocks.

SUMMARY

To solve problems found in the prior art, a method, system, and apparatus are provided for decomposing a biomass feedstock, including the provision of a layer of inert particulate matter, such as sand granules, to line and insulate the bottom surface of a main chamber of a reactor where pyrolysis and oxidation are conducted to produce char and producer gases as primary products. In an embodiment, feedstock positioned in a side region of the reaction chamber insulates side walls of the main chamber from heat in the center region of the main chamber. In an embodiment of the method, a rate of removal of solid products such as char from the reactor is controlled in response to a temperature detected at a position of an extraction tube inlet of the reactor. Activated charcoal may be obtained as a primary product using the reactor, system, and method, by feeding oxygen into the reactor at an inlet positioned adjacent to an inlet to the extraction chamber. A rate of removal of solid product and/or a rate of feeding hot gas may be controlled to favor production of char or activated charcoal as the solid product, instead of ash.

DETAILED DESCRIPTION OF ILLUSTRATIVE EMBODIMENTS

Figure 1:
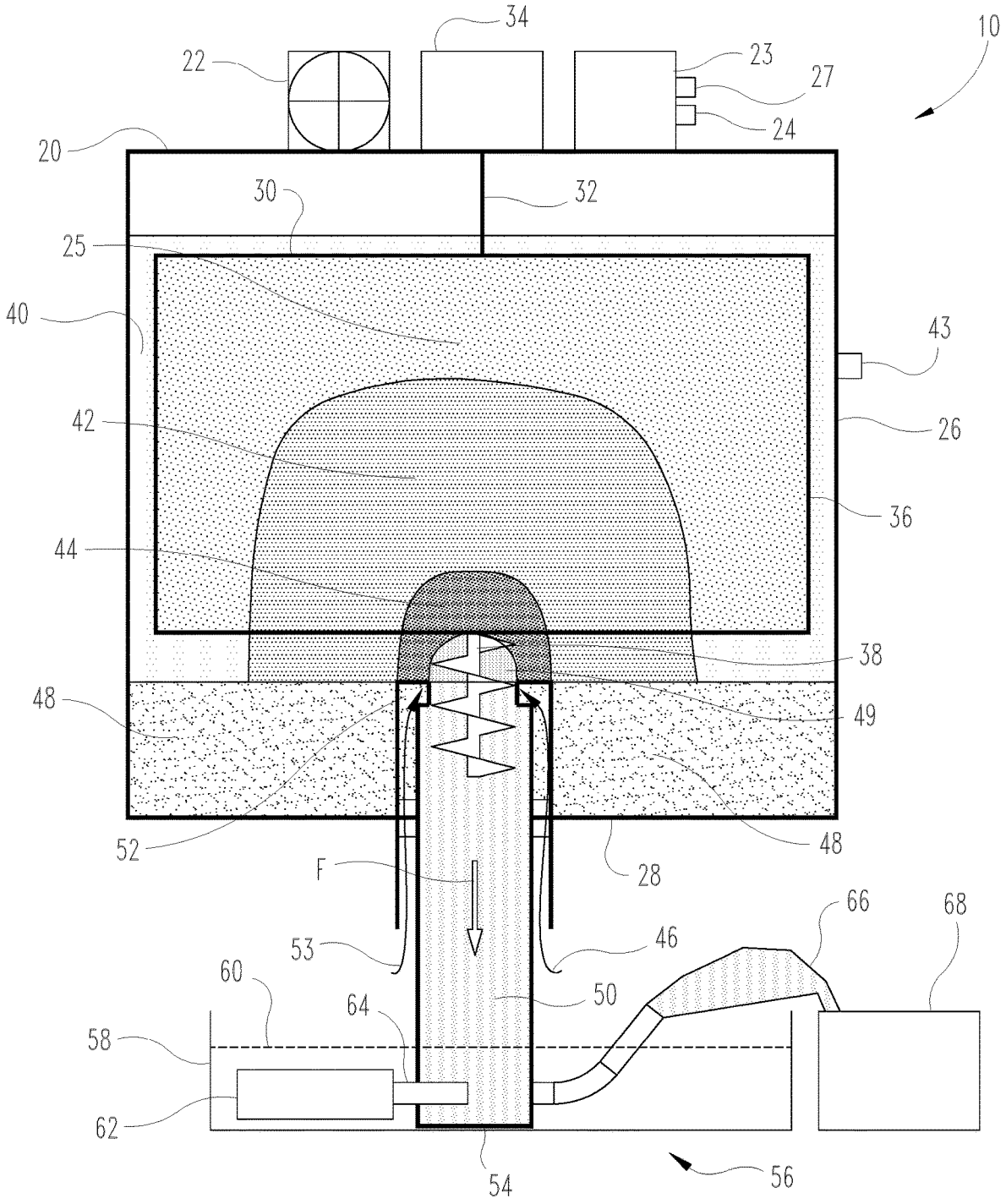
FIG. 1 is a schematic depiction of cross-sectional view of a system for biomass decomposition according to some embodiments of the invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, any alterations and further modifications in the illustrated embodiments, and any further applications of the principles of the invention as illustrated therein as would normally occur to one skilled in the art to which the invention relates are contemplated herein.

In an embodiment of the invention, there is provided a system 10 for decomposing biomass comprising a reactor having a reactor body 20 that encloses a reactor chamber, in the nature of a cavity surrounded by the body 20. The reactor chamber serves as the main chamber in which decomposition and gasification reactions take place. The reactor body 20 comprises a reactor side wall 26 and a reactor base wall 28. The reactor body 20 may preferably be formed in a cylindrical shape, or a frusto-conical shape. In the example depicted in FIG. 1, the reactor body is formed in a cylindrical shape. The side wall 26 in this example is essentially in the shape of a hollow cylinder that surrounds the interior chamber of reactor body 20 that holds biomass for decomposition. The reactor base wall 28 forms a bottom surface of the chamber of the reactor body 20.

In an embodiment, the reactor may be fabricated using a preexisting inexpensive solid storage unit, such as a hopper bottom grain bin. In an embodiment, inner surfaces of the walls of the reactor may be provided with a coating that protects the walls from the acidity of producer gas condensibles, such as pyroligneous acid and tars. In an embodiment, the body 20 differs from prior art reactor bodies which were formed from or lined with expensive heat-resistant metals, ceramics, or other refractory materials needed to withstand high temperatures.

The biomass feedstock may preferably be fed into the chamber of the reactor body 20 via a biomass inlet 22 that may be opened or closed. The biomass inlet 22 preferably may be positioned in an upper wall of the reactor body 20 so that biomass maybe fed into the chamber using a gravity feed. A product gas outlet 23 that may be opened or closed may preferably be disposed on an upper portion or a top wall of the reactor body 20 to serve as the outlet for collecting product gases formed during the decomposition reactions. A product gas temperature sensor 24 may be positioned in proximity to the gas outlet 23 to detect the temperature of the gas emitted from the body 20.

Incoming cool biomass may be used as a direct contact heat exchanger to cool and filter outgoing product gases that travel in an upward direction as shown in FIG. 1, while the gases simultaneously heat and dry the incoming biomass, to increase system efficiency. Biomass filters particulates from gases and condenses tars and acids to their dew-points. Water is evaporated until saturation is achieved, and any cooling after saturation causes condensation in upper levels of biomass in the chamber. Gases leave the reactor at a temperature between the dew-point of the incoming biomass moisture content and the temperature of the incoming biomass.

In an embodiment, an agitator 30 is disposed in a position to agitate biomass contained in the main chamber of the reactor body 20. The agitator 30 may be actuated via an actuator 32 operatively connecting the agitator 30 to an agitator-driving motor 34 or other means for moving the agitator 30 within the chamber. Preferably, the agitator rotates around a longitudinal central axis of the agitator which may be along the vertical line depicting the actuator 32 in FIG. 1. The longitudinal central axis of the agitator 30 may preferably be concentric with a longitudinal central axis of the reactor body (depicted in FIG. 1 in a cylindrical shape). In an embodiment, other types of agitation may be employed such as vibration of the chamber or the biomass by a device applying vibrational forces to the chamber and/or biomass.

Figure 2:
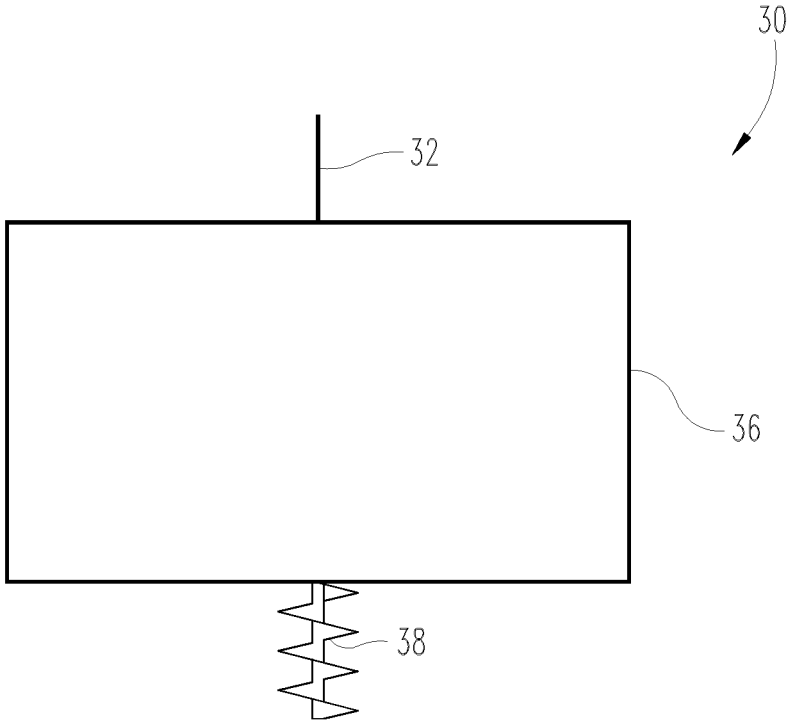
FIG. 2 is a schematic depiction of a cross-sectional view of an agitator portion of a system for biomass decomposition according to some embodiments of the invention.

As may be seen in FIG. 2, the agitator 30 may include two portions. A first (upper) portion may be formed as a paddle 36 or in a paddle-type shape, configured to have blades that rotate around the main chamber upon actuation of the agitator 30. The blades may thereby agitate that portion of the biomass that is contained in the chamber of the reactor body 20 and positioned above an inlet 52 of a second (lower) chamber of the reactor. The lower chamber of the reactor may preferably be formed as an extraction chamber in the form of an extraction tube 50 configured for extracting products of the oxidation and reduction reactions from the main chamber. The second portion of the agitator 30 may preferably be configured as or in the shape of a feed screw 38 or helical auger. The feed screw 38 maybe formed and disposed to be positioned with its lower portion disposed within the extraction tube 50, and its upper portion disposed within the main chamber 20 as shown in FIG. 1.

When operating, the agitator paddle 36 rotates and sweeps through the upper portion of the biomass fed into the chamber to level the upper portion of the biomass. The agitator paddle 36 sweeps through the bottom portion of the biomass, which is generally positioned above the extraction tube inlet 52. The agitator paddle 36 may be controlled to rotate to sweep through the biomass at a rate adequate to provide a small amount of agitation to prevent or ameliorate channeling. Any configuration of the paddle 36 or other agitation means adequate to prevent or address oxidation path channeling would be acceptable. An example of a paddle configuration is shown in, for example, Int. Pub. WO 2009/093107 A1.

During the rotation of the agitator 30, the feed screw 38 rotates and pushes solid products of the reaction down through the extraction tube inlet 52, thus preventing and/or breaking up any material bridging, and preventing the blocking of the extraction tube inlet 52 from bridged materials. Upon rotation of the agitator 30, the feed screw 38 rotates in a direction such that its blades force solid products of decomposition, such as char, to move from the main chamber into the extraction tube 50, and through the extraction tube in a downward direction (direction F as shown in FIG. 1) from the extraction tube inlet 52 toward an extraction tube outlet 54 positioned at the lower end of the extraction tube 50 as depicted in the example of FIG. 1. The inventors have discovered that the extraction tube inlet 52 preferably should have a diameter that is less than or equal to one-third (⅓) of the diameter of the main chamber of the reactor body 20.

The extraction tube 50 of the system 10 may preferably be least partly disposed within the main chamber of the reactor body 20, and may be at least partly disposed outside the main chamber of the body 20. In the exemplary embodiment depicted in FIG. 1, a lower portion of the extraction tube 50 is disposed outside the chamber of the body 20 on a bottom side of the reactor.

The feed screw 38, and those portions of the paddle 36 and/or the extraction tube 50 that are positioned in the high-temperature zone such as the oxidation zone 44 in the chamber, may preferably be formed of high-temperature resistant materials such as refractory materials, temperature-resistant metals, or ceramics, or composites of the foregoing. The material exposed to the high heat of the oxidation zone must be able to tolerate high temperatures, but a relatively small amount of such material is required to form these particular components in the embodiments of this invention, resulting in cost savings. Such material for these components disposed near the oxidation zone 44 preferably may be high temperature metals, such as stainless steels or nickel alloys, as well as refractory cement castings. In an embodiment, instead of forming these components of higher-cost materials, the operator may choose to use less heat-resistant materials for the fabrication of these components, and choose to make more frequent replacements of such components, such as in a periodic replacement schedule.

In an embodiment, there is provided a gas inlet 46, or similar apparatus for injecting or inserting fluids containing oxygen into the chamber in a position in proximity to the extraction tube inlet 52. As depicted in FIG. 1, at least one pipe or tube may lead from an exterior source of oxygen-containing vapors or fluids, such as ambient air, to at least one gas inlet 46 positioned near the extraction tube inlet. Air (or other gas such as superheated steam, heated producer gas, etc.) enters the reactor chamber through the gas inlet 46 near the perimeter of the extraction tube inlet 52 with the goal of making the point at which the char product enters the extraction tube 50 the hottest zone in the reactor via the exothermic oxidation reactions resulting from introduction of the air or other oxidizing gases, while keeping heat away from reactor walls. The preferred configuration and positioning of the gas inlet 46 inside the reactor chamber is near the central longitudinal axis of the cylindrical reactor body, sufficiently distant from the reactor side wall 26 to minimize heat transfer to the side wall 26, and sufficiently distant from the base wall 28 to minimize heat transfer to the base wall 28.

In an embodiment, at least part of the gas injected into the chamber in proximity to the extraction tube inlet 52 may be producer gas that may increase oxidation of the char or activation of the char in the chamber in the region of the extraction tube inlet 52 or in the extraction tube 50.

The tubes feeding air into the gas inlet 46 may be configured as tubes that run along a wall of the extraction tube 50, or may be configured as a concentric outer tube of a larger diameter that is concentric with the extraction tube 50 and surrounds the extraction tube 50 as its inner concentric tube. In the latter configuration, the outer tube supplying air or steam to the gas inlet 46 may be configured to act as a cooling unit that surrounds the extraction tube 50 with incoming cooler air so as to cool the extraction tube 50 while being preheated.

A char temperature sensor 49 may be provided at a position to detect temperature of the decomposition products, including char, at a position proximate to the extraction tube inlet 52. The char temperature sensor 49 preferably may measure temperature at a position at or near a central longitudinal axis of the extraction tube 50, but may be measured from other locations as may be needed to account for limitations in space availability and tolerances of the temperature sensing equipment of the sensor 49.

In an embodiment of the systems and methods, the extraction tube 50 may be configured to activate the char leaving the reactor, resulting in an activated charcoal product that may be of higher economic value than non-activated char. In an embodiment, the system may comprise a steam input system 53 designed to supply steam to the interior cavity of the extraction tube 50, such as a steam inlet and steam supply pipe or piping system connecting the steam inlet to a steam supply. The steam input system 53 may preferably supply steam to the char to activate the char inside the extraction tube 50 at a position upstream of, or above, the position of the water line 60 that forms the water seal. In an embodiment, the steam input system 53 supplies steam to the char in the extraction tube in a condition wherein the steam travels in an upward direction in the tube, and/or the interior of the tube is in an air-free condition. In an embodiment, steam injected into the extraction tube 50 from the steam input system 53 is at least partially directed in a direction within approximately forty-five (45) degrees or less from the direction F along the longitudinal axis of the extraction tube 50. In this manner the steam may be directed generally toward the extraction tube outlet 54 in a condition such that the force of the injected steam aids in forcing the char toward the extraction tube outlet 54.

In the extraction tube 50, there may be a small reduction in mass of the char as steam reacts with char, and CO and $H_2$ are generated, in reactions that may aid in cooling the char.

In an embodiment, the extraction tube 50 is configured to have a longer length proportionally to the volume of the reactor body, to allow more time for activation of the char as it passes downwardly (direction F) through the extraction tube 50.

At the extraction tube outlet 54, a char transfer system 56 preferably may be provided to receive the solid decomposition products, which may preferably hold primarily char and/or activated char, out of the extraction tube 50. According to an embodiment of the invention, the char transfer system 56 may include a receptacle in the general form of a water tank 58 that holds water so that the water surrounds the extraction tube outlet 54. In this manner, the water is held by the tank 58 in proximity to the char moving out of the outlet 54 and the water cools the char (and other solid decomposition products). In a preferred embodiment, the water is contained and maintained in the tank 58 at a level such that the water line 60 is at a position above the extraction tube outlet 54. In this manner, the water prevents entry of air into the extraction tube 50 via the extraction tube outlet 54 because the water line 60 is above the outlet 54. Thus the water provides an inexpensive and effective water seal at the bottom of the extraction tube 50. Water may be vaporized from the tank 58 and may move upward into the extraction tube 50 as water vapor, cooling the char and eventually going through a shift reaction to generate some $H_2$ and CO gases in the tube 50.

The extracted char and water may form a slurry within the tank 58. The char and/or water, or both in a slurry, may be pumped out of the tank 58 by action of a pump, such as a slurry pump 62 with an ejector, and/or an ejector pipe system 64. The ejector pipe system may include devices to move char and water through them, and to separate water from the char, such as a char auger system schematically represented by reference numeral 66 that forces char out of the tank through piping. In an embodiment, a water jet flow may entrain char in the tank 58 and carry the char to a draining system and ultimately to a char storage receptacle 68. After water is drained, char may be pushed to the storage receptacle 68 with optional drying by pushing air through the cool damp char. The removed char product may be transferred into a char storage receptacle.

As seen in the schematic representation of FIG. 1, zones may be identified in the reactor chamber containing biomass undergoing decomposition. A first zone that first receives the biomass fuel fed in from the biomass inlet 22 may be designated as a drying zone 25. The main decomposition step occurring in this zone is drying of biomass, by action of heat that drives off water in the biomass as steam. Such heat is conducted into the drying zone 25 from the hotter zones, namely the pyrolysis zone 42 and the oxidation zone 44, and from hot product gases generated by the pyrolysis and oxidation reactions in the zones 42 and 44. The hot product gases conduct heat into the drying zone 25 as they percolate, or otherwise travel upwardly, through the biomass in the drying zone 25 from the sites of the generation of such gases in exothermic reactions occurring in the pyrolysis zone 42 and the oxidation zone 44. In general, temperatures in the drying zone 25 are below approximately 300° C., and for the purposes of this disclosure the drying zone may be defined as that portion of the biomass wherein temperatures are at below approximately 300° C.

A second zone may be defined as the pyrolysis zone 42 wherein the pyrolysis reactions primarily occur, and wherein the temperatures in the zone during operation are approximately 300° C.-500° C. During pyrolysis, gases are released and solid materials are converted to char (charcoal). In typical pyrolysis decompositions, approximately 70% of the mass in the zone is converted to pyrolysis product gases. A third zone may be defined as the oxidation zone 44, wherein oxidation reactions primarily occur. Char from the pyrolysis zone 42 flows downward in the configuration shown in FIG. 1, and the down-flowing char acts as a reductant for up-flowing combustion gases. The oxidation zone 44, for the purposes of this disclosure, may be defined as that portion of the biomass wherein the temperatures are at least 500° C. The higher end of the range of temperatures in the oxidation zone 44 typically range from approximately 800° C. to 1000° C.

An aspect of an embodiment of the method, system, and apparatus is providing an insulating layer that abuts the reactor base wall 28. As described above, the decomposition reactions including pyrolysis and oxidation of the biomass fuel may be exothermic and may generate extremely high temperature conditions that may damage, deform, and decompose the materials used to form the body 20 of the reactor. As a result, some prior designs have used expensive materials to form the reactor body, and used expensive and complicated additions of ceramics or other insulation layers to protect the body from heat. The inventors have discovered that an insulating layer may be provided that abuts the reactor base wall 28 in the form of a layer 48 of granular or particulate material that lines the bottom surface of the chamber of the reactor. The insulating layer 48 insulates the base wall 28 from the high temperatures conducted from the oxidation and pyrolysis zones. The granular or particulate material may preferably be comprised of inert substances. The granular or particulate matter may preferably be in the form of grains or granules, pellets, or powders, or in a combination of one or more of grains, granules, pellets, and/or powders. The granular or particulate matter of the insulating layer 48 may be of any appropriate inert substance that will form an insulating layer in the main chamber. The matter of the insulating layer may preferably comprise any one or more of sand, gravel, dirt, or other refractory-capable substance. In an embodiment, the insulating layer 48 may be formed of sand granules. The sand granules may be loose and preferably may be fed into the chamber of the reactor 20 in abutment to the base wall 28 prior to operation of the reactor and prior to loading of biomass into the reactor chamber. Biomass and decomposing biomass materials abut the upper surface of the insulating layer 48 as shown in FIG. 1. Unlike prior solutions to the problem of providing insulation layers, such as applying expensive ceramic linings and replacing them when they deteriorate, operators may easily and inexpensively add, maintain, and replace the insulating layer 48.

An aspect of an embodiment of the method, system, and apparatus is providing an insulating layer that abuts the reactor side wall 26. In an embodiment, biomass, and/or partly decomposed biomass materials, such as char, or a combination of biomass and such partly decomposed materials, may themselves be provided as a biomass insulating zone or layer 40 that protects the side wall 26 of the reactor body from exposure to heat emanating from the pyrolysis zone 42 and oxidation zone 44. In the embodiment, the method, system or apparatus employs the biomass and char as low-cost and easily replaceable refractory material to provide the insulation to the reactor body wall by centralizing the exothermic reactions away from the side wall 26. This enables very low cost reactor construction, which allows the reactor volume to be very large without while still being inexpensive. The large volume allows the residence time in the reactor to increase, increasing the reactor efficiency and the gas outlet temperature to nearly the biomass input temperature.

In an embodiment, the method may comprise stirring the biomass in the center region of the chamber 20 of the reactor, while the biomass abutting the side region (lining the side wall 26) of the chamber is not stirred, and thus remains in a position adjacent to or abutting the side wall 26 of the reactor body 20. As depicted in FIG. 1, an insulating biomass layer 40 comprised of biomass and/or partially decomposed biomass materials such as char is positioned between the side wall 26 and a position of an outermost blade of the paddle 36 of the agitator 30. The paddle 36 may be rotated, as previously described, to stir the materials in the center region while leaving undisturbed the materials positioned between the side wall 26 and the blade of the paddle 36. The center region, for the purposes of this exemplary embodiment, may be defined as the region inside the outer boundaries of the paddle 36 as depicted in FIG. 1.

In combination, the above-described embodiments of the method, apparatus and system provide conditions for conducting oxidation reactions near the center of the reactor, with only biomass providing insulation to the side wall 26 of the reactor body and only the sand layer 48 providing insulation to the base wall 28 of the reactor. In this manner, biomass, char, and sand may be used as low-cost refractory insulation, controlling the oxidation zone and protecting the reactor body walls.

In an embodiment of the method, apparatus, and system, there is provided a system or apparatus for, or a step of, controlling the rate of extraction of the char from the extraction tube outlet 54 of the extraction tube 50. In an embodiment, actuation and/or control of rate of operation of an auger or auger system is conducted to control the char extraction rate. In an embodiment, actuation and/or control of a rate of pumping speed, or other operation, of the slurry pump may be conducted to control the char extraction rate. The actuation and/or control of rate of operation of the extraction apparatus, such as the slurry pump, auger, or other removal apparatus, may be conducted in response to a temperature detected in or near the oxidation zone 44 of the main chamber, whereby the extraction rate may be controlled in response to an increase or decrease in a temperature, or detection of a threshold temperature or variance above or below a threshold temperature, in or near the oxidation zone 44. In an example, the temperature may be detected by a temperature sensor 49 located in proximity to the char extraction tube inlet 52. For example, in response to detection of a temperature by a sensor 49 in the oxidation zone 44 that meets or exceeds a threshold temperature, the operation of the auger or slurry pump may be conducted in a matter that increases a rate of removal of material from the extraction tube outlet 54 and/or the tank 58. In turn, this faster removal tends to draw more of the cooler biomass into, or closer to, the oxidation zone 44 from the drying zone 25. In an exemplary application, the rate of removal thus may be controlled to favor temperature conditions that favor reactions producing desired products, such as char or activated charcoal, or certain process gases, instead of favoring more complete oxidation reactions resulting in ash as the solid product.

In another example, in response to detection of a temperature in the oxidation zone 44 that is lower than a threshold temperature, the operation of the auger system or slurry pump 62 may be conducted in a matter that decreases a rate of removal of material from the extraction tube outlet 54 or the tank 58. In turn this lower rate of removal may help maintain a desired temperature level in the oxidation zone 44 to favor production of desired products.

In an embodiment of the system and method, there may be provided a system or apparatus for, or a step of, sensing an amount or level of biomass that has been loaded into the chamber. For example, a bed level may be detected by a bed level sensor. Actuation and/or control of input equipment that moves biomass through the chamber biomass inlet 22 may be controlled in response to the detected bed level. Because reactor volume may be quite large, there may be a large range of acceptable bed levels.

In an embodiment of the system, apparatus, and method, there may be provided a system or apparatus for, or a step of, sensing a temperature at a position along a side wall 26 of the reactor body. A temperature sensor 43 may be disposed at a position along a side wall 26 to measure a temperature of biomass located in the zone near the side wall 26. Operation of the reactor may be controlled in response to the temperature exceeding a threshold temperature. The high temperature may indicate a breach in the insulating biomass layer 40 comprised of biomass and/or partially decomposed biomass materials positioned between the side wall 26 and the paddle 36 of the agitator 30, and operation of the reactor may be slowed or stopped in response to a signal indicating a breach or gap in the insulating biomass layer 40, to allow biomass loading to correct the breach. In this manner, a side wall temperature sensor 43 positioned along the reactor perimeter would detect oxidation due to leaks near oxidation zones and send a shutdown signal to control operation of the reactor. In an analogous embodiment, a product gas outlet oxygen sensor 27 disposed near the gas outlet 23 may sense oxygen levels at the position of the oxygen sensor 27, and an oxygen level that exceeds a threshold may be used to generate a signal to control operation of the reactor.

In an embodiment of the system and method, there may be provided a system or apparatus for, or a step of, driving or pulling gas, including product gas, out of the product gas outlet 23 of the reactor, by action of a fan or an engine inlet. In an embodiment, a gas temperature sensor 24 would detect a gas temperature at a position of the product gas outlet 23, and in response to the temperature of the gas exceeding a threshold, the gas extraction rate would be controlled. The gas extraction rate might be controlled to be lower in a condition in which the temperature detected at the outlet 23 exceeds a threshold, tending to indicate that the bed height had become too low, or in a condition where the rate of gas flow should be lowered because the high temperature gas might be undesirable due to, for example, possibly causing excessive heat damage to an engine via entry through the engine inlet. In an example, rate of gas flow out of the reactor through the product gas outlet may be controlled in response to the product gas input needs of an engine, by controlling actuation and/or rate of operation of a fan that drives gas flow out of the product gas outlet.

In an embodiment of the system and method, there may be provided a system or apparatus for, or a step of, arresting the decomposition reactions at a point that avoids oxidation of char, to maximize the amount of char that is produced as the product of the decomposition. The reactor and the method of production may be controlled to maximize the proportion of char in the resulting solid product of the pyrolysis reactions. In prior methods and systems, char has not been produced as the primary and favored output of the reactor, and so conditions were controlled to maximize production of producer gas instead of char. Utilizing the instant embodiments of the system, apparatus, and method, the char product intrinsically has the ash locked into it, so slagging issues can be reduced or eliminated, allowing a simpler and lower cost outlet system. The hot char can be cooled by incoming non-oxidizing gases such as water vapor. This water vapor gains in temperature while cooling the char, with the hot gas resulting leading to the reactor to help drive the reaction.

In summary, disclosed is a method for decomposing a feedstock, which may include one or more or all of the following features: providing a layer of inert particulate matter abutting a bottom surface of a main chamber of a reactor, the reactor having an extraction chamber disposed at least partially within the main chamber, and the extraction chamber having an extraction chamber inlet positioned within the main chamber in a center region of the main chamber above a bottom surface of the main chamber, wherein the layer of particulate matter is disposed between the bottom surface of the main chamber and the extraction chamber inlet, feeding the feedstock into the main chamber, conducting pyrolysis of the feedstock in the main chamber, and removing solid product from the main chamber via the extraction chamber.

The above method may further include one or more or all of the features of: feeding hot gas into the main chamber, the hot gas being superheated steam; and/or conducting oxidation of the feedstock. The method may be conducted with the particulate matter comprising or consisting of or essentially of sand. The method may be conducted with the solid product comprising char or consisting of or consisting essentially of char. The method may further include all of the preceding features and further may be conducted with one or more or all of: the biomass feedstock positioned in a side region of the main chamber insulating side walls of the main chamber; the feedstock being fed through the center region of the main chamber while minimizing movement of feedstock positioned in a side region of the main chamber adjacent to side walls of the main chamber; the feedstock in the center region of the main chamber being stirred and the feedstock in a side region of the main chamber being not stirred; and wherein the stirring is conducted by a stirrer configured to move the feedstock in the center region of the main chamber and to minimize movement of feedstock in the side region.

The method also may be further conducted with any or all of the preceding features, and also including one or more or all of solid product removal conducted by pumping a slurry comprising the solid product and water out of the extraction chamber; removing the solid product from an outlet of the extraction chamber using an auger; and/or conducting removal wherein a rate of removal of solid product is controlled in response to a temperature detected at a position of the extraction tube inlet. The method may be conducted with any or all of the preceding features, and also including one or more or all of being conducted as a method for gasifying a feedstock, comprising: providing a layer of inert particulate matter to insulate a bottom surface of a main chamber of a reactor, the reactor having an extraction chamber disposed at least partially within the main chamber, and the extraction chamber having an extraction chamber inlet positioned within the main chamber in a center region of the main chamber above a bottom surface of the main chamber, wherein the layer of particulate matter is disposed between the bottom surface of the main chamber and the extraction chamber inlet, feeding the feedstock into the main chamber, and conducting pyrolysis of and at least partial oxidation of the feedstock in the reactor to generate gas.

The method further may include all of the preceding features, and also include one or more or all of feeding an oxygen-containing fluid into the chamber at an inlet positioned adjacent to the extraction chamber inlet, whereby oxidation is conducted in the extraction chamber; being conducted for the production of producing char, comprising, providing a layer of inert particulate matter lining a bottom surface of a main chamber of a reactor, the reactor having an extraction chamber disposed at least partially within the main chamber, and the extraction chamber having an extraction chamber inlet positioned within the main chamber in a center region of the main chamber above a bottom surface of the main chamber, wherein the layer of particulate matter is disposed between the bottom surface of the main chamber and the extraction chamber inlet, feeding the feedstock into the main chamber, and heating the feedstock in the reactor to induce pyrolysis to yield char. The method further may include all of the preceding features, and also include one or more or all of removal of the char by pumping a slurry comprising the char and water out of the extraction chamber; and/or removal of the char by entraining the char in a downward flow of water from a water inlet disposed in a vicinity of the extraction chamber outlet.

The embodiments disclosed include a reactor for decomposing a biomass feedstock that may include one or more or all of the foregoing features, and may further include one or more or all of: a main chamber adapted for conducting pyrolysis of the feedstock, an extraction chamber disposed at least partially within the main chamber, the extraction chamber having a extraction chamber inlet positioned within the main chamber in a center region of the main chamber above a bottom surface of the main chamber, wherein a lower region of the main chamber is configured as a basin holding a layer of inert particulate matter along the bottom surface of the main chamber, the basin being disposed between the bottom surface of the main chamber and the extraction chamber inlet; a stirrer configured to move the feedstock in the center region of the main chamber and to minimize movement of the feedstock in a side region of the main chamber; an inlet for feeding oxygen-containing fluids into the chamber at a position adjacent to the extraction chamber inlet; wherein a char product of the pyrolysis is at least partially oxidized in the extraction tube to produce activated char; wherein a diameter of the extraction chamber inlet is less than or equal to one-third (⅓) of a diameter of the main chamber; comprising a water receptacle positioned to hold water to surround an outlet of the extraction chamber; and/or wherein the water surrounding the extraction chamber outlet forms a water seal preventing entry of air into the extraction chamber.

The operations illustrated for the processes in the present application are understood to be examples only, and operations may be combined or divided, and added or removed, as well as re-ordered in whole or in part, unless explicitly stated to the contrary. It is understood that the operations for the processes in the present application may be conducted or controlled by one or more components of a controller of the method, system, and apparatus and/or their associated sensors, as described above in more detail with respect to FIG. 1.

One of skill in the art may appreciate from the foregoing that unexpected benefits are derived from application of the method, system, and apparatus to the problem of improving efficiency in operating a biomass decomposition system, without the need for additional components or parts, or changes in the configuration of conventional components or their features. Additional components and parts may add costs and complexity to manufacture, operation, and maintenance of the system. A key benefit contemplated by the inventors is improvement of efficiency in biomass decomposition, through use of the disclosed system, method, or apparatus, while excluding any additional components, steps, or change in structural features. In this exclusion, maximum cost containment may be effected. Accordingly, the substantial benefits of simplicity of manufacture, operation, and maintenance of the apparatus and the system, and use of the method, may most preferably reside in an embodiment of the invention consisting of or consisting essentially of the features of the method, system, or apparatus disclosed herein. Thus, embodiments of the invention contemplate the exclusion of steps, features, parts, and components beyond those set forth herein, and contemplate, in some embodiments, the exclusion of certain steps, features, parts, and components that are set forth in this disclosure.

While the invention has been described in connection with what is presently considered to be the most practical and preferred embodiment, it is to be understood that the invention is not to be limited to the disclosed embodiment(s), but on the contrary, is intended to cover various modifications and equivalent arrangements included within the spirit and scope of the appended claims, which scope is to be accorded the broadest interpretation so as to encompass all such modifications and equivalent structures as permitted under the law. Furthermore it should be understood that while the use of the word preferable, preferably, or preferred in the description above indicates that feature so described may be more desirable, it nonetheless may not be necessary and any embodiment lacking the same may be contemplated as within the scope of the invention, that scope being defined by the claims that follow. In reading the claims it is intended that when words such as "a," "an," "at least one" and "at least a portion" are used, there is no intention to limit the claim to only one item unless specifically stated to the contrary in the claim. Further, when the language "at least a portion" and/or "a portion" is used the item may include a portion and/or the entire item unless specifically stated to the contrary. The words "a" and "one" are defined as including one or more of the referenced item unless specifically noted. The phrase "at least one of" followed by a list of two or more items, such as "A, B or C," means any individual one of A, B or C, as well as any combination thereof. Words such as "upper," "lower," "top," "bottom," "first," and "second" designate directions in the drawings to which reference is made. This terminology includes the words specifically noted above, derivatives thereof, and words of similar import.

The invention claimed is:

1. A method for decomposing a feedstock, comprising:

providing a layer of inert particulate matter in a main chamber of a reactor, the reactor having an extraction tube disposed at least partially within the main chamber, the extraction tube extending through the layer of inert particulate matter and having an extraction chamber inlet positioned within the main chamber above a bottom of the main chamber, and the extraction tube including an extraction chamber extending from the extraction chamber inlet to an extraction chamber outlet disposed outside of the reactor below the main chamber, wherein the layer of particulate matter is disposed between the bottom of the main chamber and the extraction chamber inlet;

feeding the feedstock into the main chamber through a feedstock inlet of the reactor;

stirring the feedstock with an agitator that includes a paddle in the main chamber above the extraction chamber inlet;

conducting pyrolysis of the feedstock in the main chamber;

removing solid product produced by pyrolysis of the feedstock from the main chamber through the extraction chamber via the extraction chamber inlet with a feed screw of the agitator that extends from the paddle into the extraction chamber; and controlling a rate of removal of solid product from the extraction chamber outlet in response to a temperature detected at a position of the extraction chamber inlet to maintain a desired temperature level in proximity to the extraction chamber inlet to favor production of desired products instead of ash.

2. The method according to claim 1, comprising feeding heated gas into the main chamber.

3. The method according to claim 2, wherein the heated hot gas is superheated steam.

4. The method according to claim 1, comprising conducting oxidation of the feedstock in the main chamber.

5. The method according to claim 1, wherein the particulate matter comprises sand.

6. The method according to claim 1, wherein the solid product produced by the pyrolysis is char and the char is at least partially oxidized in the extraction chamber to produce activated char.

7. The method according to claim 1, wherein the solid product comprises char.

8. The method according to claim 1, wherein the solid product consists essentially of char.

9. The method according to claim 1, wherein the feedstock positioned in a side region of the main chamber insulates side walls of the main chamber from heat in a center region of the main chamber.

10. The method according to claim 1, wherein the feedstock is fed through a center region of the main chamber while minimizing movement of feedstock positioned in a side region of the main chamber adjacent to side walls of the main chamber.

11. The method according to claim 1, wherein the feedstock in a center region of the main chamber is stirred and the feedstock in a side region of the main chamber is not stirred.

12. The method according to claim 11, wherein the paddle is configured to move the feedstock in the center region of the main chamber and to minimize movement of feedstock in the side region.

13. The method according to claim 1, wherein the solid product removal is conducted by pumping a slurry comprising the solid product and water out of the extraction chamber.

14. The method according to claim 1, comprising removing the solid product from the extraction chamber outlet of the extraction chamber using an auger.

15. The method according to claim 1, wherein a rate of removal of solid product is controlled in response to a temperature detected at a position of the extraction tube inlet.

16. The method according to claim 1, wherein the layer of inert particulate matter abuts the bottom of the main chamber of the reactor, and the extraction tube is provided in a center region of the main chamber.

17. A method for gasifying a feedstock, comprising:

providing a layer of inert particulate matter to insulate a bottom surface of a main chamber of a reactor, the reactor having an extraction tube disposed at least partially within the main chamber and extending through the layer of inert particulate matter, the extraction tube having an extraction chamber inlet positioned within the main chamber in a center region of the main chamber above the bottom surface of the main chamber, wherein the layer of particulate matter is disposed between the bottom surface of the main chamber and surrounds the extraction chamber inlet, the extraction tube including an extraction chamber extending from the extraction chamber inlet to an extraction chamber outlet disposed outside of the reactor below the main chamber;

feeding the feedstock into the main chamber by gravity through a feedstock inlet in an upper wall of the reactor;

feeding an oxygen-containing fluid through a tube positioned around the extraction tube into the extraction chamber at an inlet positioned around a perimeter of the extraction chamber inlet so that the extraction chamber inlet is the hottest zone in the reactor and oxidation is conducted in the extraction chamber;

conducting pyrolysis of, and at least partial oxidation of, the feedstock in the reactor to generate gas, wherein a solid product produced by the pyrolysis is char and the char is at least partially oxidized in the extraction chamber to produce activated char.

18. The method of claim 17, wherein removing solid product produced by the pyrolysis of the feedstock from the main chamber via the extraction chamber includes controlling a rate of removal of solid product from the extraction chamber outlet in response to a temperature detected at a position of the extraction chamber inlet to maintain a desired temperature level in proximity to the extraction chamber inlet to favor production of desired products instead of ash.

19. A method for producing char, comprising:

providing a layer of inert particulate matter in a main chamber of a reactor, the reactor having an extraction tube disposed at least partially within the main chamber and extending through the layer of inert particulate matter, and the extraction tube having an extraction chamber inlet positioned within the main chamber above the layer of inert particulate matter in the main chamber, the extraction tube including an extraction chamber extending from the extraction chamber inlet to an extraction chamber outlet disposed outside of the reactor below the main chamber;

feeding the feedstock into the main chamber through a feedstock inlet of the reactor; and heating the feedstock in the reactor to induce pyrolysis to yield solid product in the form of char; and stirring the feedstock with an agitator that includes a paddle in the main chamber above the extraction chamber inlet while feeding the solid product from the main chamber through the extraction chamber inlet with a feed screw of the agitator that extends from the paddle into the extraction chamber to remove the solid product through the extraction chamber outlet, wherein a char product of the pyrolysis is at least partially oxidized in the extraction chamber to produce activated char.

20. The method according to claim 19, comprising removing of the char by pumping a slurry comprising the char and water out of the extraction chamber.

21. The method according to claim 19, comprising removing the char by entraining the char in a downward flow of water from a water inlet disposed in a vicinity of the extraction chamber outlet.

22. The method according to claim 19, wherein the layer of inert particulate matter lines the bottom surface of the main chamber of the reactor, and the extraction tube is provided in a center region of the main chamber.

23. The method according to claim 22, wherein the layer of inert particulate matter is disposed at the bottom surface of the main chamber and surrounds the extraction chamber inlet.

* * * * *